US005422159A

United States Patent [19]

Fagan

[11] Patent Number: 5,422,159

[45] Date of Patent: Jun. 6, 1995

[54] FLUORPOLYMER SHEETS FORMED FROM HYDROENTANGLED FIBERS

[75] Inventor: Joseph P. Fagan, Plumsteadville, Pa.

[73] Assignee: Ausimont U.S.A., Inc., Morristown, N.J.

[21] Appl. No.: 353,495

[22] Filed: Dec. 8, 1994

[51] Int. Cl.[6] ..... B32B 3/10

[52] U.S. Cl. ..... 428/131; 28/103; 28/104; 28/105; 428/134; 428/224; 428/299; 428/421; 428/422

[58] Field of Search ..... 428/224, 299, 131, 421, 428/422, 134; 28/103, 104, 105

[56] References Cited

U.S. PATENT DOCUMENTS

| | | | |
|---|---|---|---|
| 3,485,706 | 12/1969 | Evans . | |
| 4,031,283 | 6/1977 | Fagan | 428/280 |
| 4,210,515 | 7/1980 | Patil et al. | 204/266 |
| 4,411,928 | 10/1983 | Baldwin | 427/2 |
| 4,499,139 | 2/1985 | Schortmann | 428/245 |
| 4,840,829 | 6/1989 | Suzuki et al. | 428/131 |
| 4,967,740 | 11/1990 | Riedel | 128/156 |
| 5,165,394 | 11/1992 | Hochberg | 128/201.25 |
| 5,165,399 | 11/1992 | Hochberg | 128/205.12 |

FOREIGN PATENT DOCUMENTS

WO94/09735 5/1994 WIPO .

OTHER PUBLICATIONS

Honeycomb Hydroentanglement For Soft, Strong, Nonwovens, Valmet Paper Machinery, Honeycomb Systems, Inc., Biddleford, Maine.

*Primary Examiner*—James J. Bell

*Attorney, Agent, or Firm*—John G. Gilfillan; Raymond J. Lillie

[57] ABSTRACT

A sheet or web of fluoropolymer fibers, such as ethylene/chlorotrifluoroethylene fibers, which has been hydroentangled. Such hydroentangled sheets or webs may be employed as filters, masks, membranes, synthetic papers, industrial fabrics, or liquid separators for use in oil-in-water or water-in-oil emulsions.

29 Claims, No Drawings

FLUORPOLYMER SHEETS FORMED FROM HYDROENTANGLED FIBERS

This invention relates to sheets or webs formed from fluoropolymer fibers. More particularly, this invention relates to fluoropolymer fiber sheets or webs in which the fluoropolymer fibers are hydroentangled.

Webs or sheets of halopolymer fibers, such as, for example, fluoropolymer fibers, may be formed by a variety of methods, including but not limited to, melt blowing, dry laying or air laying, melt spinning or spin bonding, wet laying, and carding.

In a typical melt blowing process, a thermoplastic resin is fed into an extruder, such as a screw type extruder, which through heat and shear pressures melts the thermoplastic resin. The molten polymer is then pumped by a metering pump through a fine holed die. As the molten resin is extruded from the die, heated air (also known as primary air) is also pumped out of the die, which results in the ejection of very fine streams of molten polymer. The air attenuates the streams of molten polymer into fibers, which are cooled or quenched almost immediately after exiting the die by secondary air. The fibers are directed to a revolving wheel, or a conveyor belt, both of which may, for example, be comprised of a screen, such as, for example, a Teflon screen, a metallic screen, or a metallic screen coated with Teflon. As the fibers travel to the wheel, cooling and some entanglement takes place so that the solid fibers deposit on the screen, and can be "peeled off" as a continuous web after the wheel has rotated 180°. Such webs have a high surface area and are of a sheetlike structure.

In a melt spinning or spin bonding process, continuous filaments are extruded onto a collection belt, and subsequently consolidated or bonded by mechanical, chemical, or thermal means. Four continuous operations are involved: (i) filament extrusion; (ii) filament drawing; (iii) filament layering (web formation); and (iv) bonding. Most spin bonding processes use melt extruders. Upon extrusion, individual filaments are separated and/or oriented aerodynamically, electrostatically or mechanically and patterned into a web on an apron or collection conveyor. The web then is consolidated by one or a combination of the following methods: (i) mechanical entanglement using needle looms; (ii) adhesive bonding using latexes; (iii) inherent bonding using acids, solvents, or gases to etch the filament surfaces, and calender rolls to interlock the structure; and (iv) thermal bonding using heated calender rolls. Following consolidation, further mechanical and/or chemical fabric finishing operations can be incorporated.

Air laid non-woven webs in general are formed on single machines. In this technology, air currents and vacuum boxes are used to transport, mix, and collect fibers. Use of air in this manner handles a wide variety of fiber geometries, properties, and fiber combinations. Air laid systems designed to process textile-length fibers employ a mechanical fiber opening apparatus to prepare a loose batt of fiber tufts. The batt is fed mechanically through a feed roll/feed plate arrangement onto a metal-toothed lickerin roll which separates the fiber tufts and combines the fibers into a controlled air suspension and into a venturi zone where the fibers are tumbled while being transported to a collection screen.

In the wet laying or wet forming process, fibers are suspended in water, brought to a forming unit where the water is drained off through a wire screen and the fibers are deposited on the wire screen, and then the fibers are picked off the wire screen to be dried. During the wet laying process, binders may be applied to the fibers before or after web formation in order to promote bonding of the fibers. Web drying and binder activation may be accomplished with steam-heated cans. At the end of the processing line, calender or other specialized rolls may be employed to densify, smooth, and soften the sheet or web.

In carding, tufts of extruded fibers or fiber blends are combed and transformed into fibrous webs in which individual fibers are held by cohesion. As individual fibers are straightened by being pulled through the machinery, fiber orientation is mostly in the direction of flow through the machine. Different fiber orientations can be made by scrambling or randomizing the webs or by plaiting the webs through the use of a lapping device.

Webs or sheets formed from processes such as those hereinabove described have various applications.

Such sheets or webs may be formed into, for example, inserts used in conjunction with conventional textiles; ultrafilters for liquids (eg., blood) and gases; surgical face masks; industrial face masks; battery separators; pocket filters; automotive and air cabin filters; pleated liquid filters contained in plastic cartridges; micron rated filter vessel bags; coolant filtration media; diaper interfacings; wound dressings; sanitary products; medical garments; sheeting; drapes; disposable clothing; diapers; protective clothing; outdoor fabrics; netting; membranes; rope; cordage; wiping cloths; synthetic papers; tissue products; and coverstock.

The fibers contained in melt blown sheets or webs are characterized by extremely fine denier. Such webs or sheets, however, may be of very low strength because the fiber diameters are small and the fibers are not drawn. Also, these fibers are not attached in any way to each other by a binder. Thus, the formed web depends only on fiber-to-fiber friction for its strength. In addition, when webs are formed of extruded fibers of fluoropolymers such as ethylene/chlorotrifluoroethylene copolymer, such fibers solidify very quickly, which provides very little time for the fiber streams to entangle. The fibers also have an increased surface area at a very low weight.

It is therefore an object of the present invention to provide a sheet or web of fluoropolymer fibers having increased strength, and less tendency to shed fibers.

In accordance with an aspect of the present invention, there is provided a hydroentangled halopolymer sheet or web, in particular a hydroentangled fluoropolymer sheet or web.

In one embodiment, the fluoropolymer is selected from the group consisting of ethylene/chlorotrifluoroethylene copolymer, ethylene/tetrafluoroethylene copolymer, tetrafluoroethylene/perfluoropropylvinyl ether copolymer (PFA), tetrafluoroethylene/hexafluoropropylene copolymer, tetrafluoroethylene/perfluoromethylvinyl ether copolymer (MFA), polyvinylidene fluoride, polyvinyl fluoride, hexafluoroisobutylene/vinylidene fluoride copolymer, polytetrafluoroethylene, and polychlorotrifluoroethylene. A particularly preferred fluoropolymer is an ethylene/chlorotrifluoroethylene copolymer.

The ethylene/chlorotrifluoroethylene copolymer may have from about 40 mole % to about 60 mole % ethylene, and from about 40 mole % to about 60 mole % chlorotrifluoroethylene. Preferably, the ethylene/-chlorotrifluoroethylene copolymer includes from about 45 mole % to about 55 mole % ethylene, and from about 45 mole % to about 55 mole % chlorotrifluoroethylene. Most preferably, the ethylene/chlorotrifluoroethylene copolymer includes about 50 mole % ethylene and about 50 mole % chlorotrifluoroethylene.

The ethylene/chlorotrifluoroethylene copolymer may have an average molecular weight of from about 10,000 to about 3,000,000, preferably from about 10,000 to about 500,000.

It is also preferred that the halopolymer has a high melt index. Preferably, the halopolymer has a melt index of at least about 100, and more preferably from about 100 to about 1,000. Melt index is determined according to ASTM procedure D-1238. Melt index is based upon the amount of resin flow in grams, through a 0.0825 inch diameter orifice at 275° C. and 2,160 grams total load, in 10 minutes.

In one embodiment, the hydroentangled fluoropolymer sheet or web is formed from fluoropolymer fibers having a diameter of from about 0.2 μm to about 10 μm and preferably from about 1 μm to about 9 μm, more preferably from about 1 μm to about 7 μm, and most preferably from about 3 μm to about 7 μm.

The hydroentangled fluoropolymer sheet or web may be formed initially by forming a sheet or web or fluoropolymer fibers by one of the sheet-forming or web-forming methods hereinabove described, including but not limited to, melt blowing, dry laying or air laying, melt spinning or spin bonding, wet laying, and carding. It is to be understood, however, that the scope of the present invention is not intended to be limited to any specific method of initial formation of a sheet or web of fibers.

Upon formation of the sheet or web of fibers, the sheet or web is subjected to hydroentanglement. In general, hydroentanglement provides for fiber rearrangement within a preformed web by means of fluid forces. In the hydroentanglement process, the sheet or web is contacted with a plurality of water jets at high pressure. In one embodiment, a first plurality of water jets contacts the sheet or web at a first surface, and then a second plurality of water jets contacts the sheet or web at a second surface which is in apposition to the first surface. The contacting of the sheet or web with the plurality of water jets entangles and distributes the fibers, thereby providing for a more homogeneous distribution of fibers in the sheet or web, as well as better interlocking of the fibers with one another, thereby providing a sheet or web of fibers having increased strength with respect to sheets or webs that are not hydroentangled. Also, such webs have less tendency to shed fibers.

Because hydroentanglement involves contacting a sheet or web of fibers with water, hydroentanglement normally is employed in the treatment of sheets or webs made of hydrophilic materials. Such materials include cellulose, rayon, nylon, and polyester. Fluoropolymers, such as ethylene/chlorotrifluoroethylene polymers, for example, are hydrophobic and sheets or webs made of fibers of such materials would not be expected to benefit from hydroentanglement. Applicant has found surprisingly, however, that a web or sheet of fluoropolymer fibers, such as ethylene/chlorotrifluoroethylene fibers, may be subjected to hydroentanglement, and the resulting sheet or web has a more homogeneous distribution of fibers and improved strength with respect to the sheet or web prior to hydroentanglement.

In accordance with another aspect of the present invention, there is provided a process which comprises (a) forming a sheet or web of fibers of a fluoropolymer; and (b) hydroentangling the fibers of said web or sheet.

The sheet or web of fibers may be formed initially by melt blowing, dry laying or air laying, melt spinning or spin bonding, wet laying, or carding.

In one embodiment, the sheet or web of fluoropolymer fibers is formed by melt blowing. In a preferred embodiment, a fluoropolymer, such as, for example, an ethylene/chlorotrifluoroethylene copolymer is extruded at a temperature of from about 460° F. to about 550° F., preferably from about 460° F. to about 500° F., and at a pressure of from about 100 psi to about 1,500 psi, preferably from about 400 psi to about 1,000 psi. After the polymer is extruded, it is attenuated by heated air into melt blown fibers, which are collected upon a receiving means, such as a rotary drum or conveyor screen positioned at from about 2.0 inches to about 7.0 inches, preferably from about 3.0 inches to about 5.0 inches, from the extruder die. As the fibers are collected upon the receiving means, they form a web of fibers which may be employed for the various uses hereinabove described with respect to other polymer webs.

As the fibers are extruded and collected upon the receiving means, the fibers may be calendered or non-calendered. In general, the non-calendered fibers are round in shape and entangled with little evidence of thermal bonding.

Calendering of the fibers, when employed, is effected at a temperature of from about 50° C. to about 200° C., preferably from about 70° C. to about 100° C., and at minimal pressure; in general from about 10 psi to about 100 psi. Such calendaring, in general, flattens the fibers into ribbon-like structures, as well as decrease the void volume in the web. Calendering may also reduce substantially the pore sizes of the webs.

Once the initial sheet or web is formed, it is subjected to hydroentanglement. In one embodiment, the sheet or web is placed between a first plurality of headers and a first cylindrical roller or drum, which includes a wire mesh screen. The roller is in the form of a cylinder and includes a wire mesh screen upon which the sheet or web rests. The screen also provides for drainage of water from the sheet or web subsequent to the hydroentanglement treatment. The wire mesh screen, for example, may be a 100 mesh screen. The sheet or web rests upon the wire mesh screen and below the headers. The headers emit jets of water, which pass through a strip of orifices. The orifice strip has a plurality of small openings, each having a diameter of from about 0.0035 inch to about 0.0070 inch, preferably at about 0.0050 inch. The openings are spaced such that there are from about 30 to 60 openings per lineal inch of orifice strip, preferably about 40 openings per lineal inch of orifice strip. The orifice strip should have a length which spans the width of the sheet or web, and the strip may have a width of about ½ inch. The water jets pass through the orifice strips and contact the sheet or web at a first surface at a pressure of from about 100 psi to about 2,000 psi, preferably from about 350 psi to about 1,500 psi. The sheet or web is passed under the water jets at a speed of from about 25 feet per minute (fpm) to about 400 fpm, preferably from about 25 fpm to about 150 fpm.

After the sheet or web is contacted with the water on a first surface, the sheet or web is rolled off the first roller and brought into contact with a second roller having a wire mesh screen as hereinabove described such that the first surface contacts the second roller. The sheet or web then is taken up by the second roller such that a second surface of the sheet or web, which is in apposition to the first surface of the sheet or web, becomes disposed such that the second surface faces a second set of water jets emitted from a second plurality of headers and orifice screens. The sheet or web is passed under the second set of water jets and contacted with such water jets under conditions hereinabove described. Once the second surface of the sheet or web has been contacted with the water jets, the sheet or web is rolled off the second roller and passed through an air drier in order to dry the sheet or web. Once the sheet or web is dried, it may be rolled onto a take-up winder roll for transport or storage. An example of a hydroentanglement procedure which may be employed is described in "Honeycomb Hydroentanglement for Soft, Strong, Nonwovens." Valmet Paper machinery, Honeycomb Systems, Inc., Biddeford, Me.

It is to be understood, however, that the scope of the present invention is not to be limited to any specific method of hydroentanglement.

The invention now will be described with respect to the following example; however, the scope of the present invention is not intended to be limited thereby.

EXAMPLE 1

Samples 1 through 15 of an equimolar ethylene/chlorotrifluoroethylene copolymer were subject to melt blown processing under the following conditions:

Melt Blown Die Configuration
Orifice Diameter: 15 mils
Orifice Length/Diameter: 15/1
Number of Orifices: 120 (20/inch×6 in)
Polymer Throughput Rate: 0.58 g/min./hole
Air Gap: 60 mils
Die Tip Setback: 60 mils
Extruder Conditions
Screw Diameter: 1.25 inches
Screw Type: single screw
30/1 Length/Diameter ratio

| Processing Temperatures (°C.) | |
|---|---|
| Extruder | |
| Zone 1 | 198.0 |
| Zone 2 | 248.0 |
| Zone 3 | 248.0 |
| Adapter | 248.0 |
| Screen Pack | 248.0 |
| Die | 254.4 |
| Air (in die) | 286.1 |

Pressures
Melt Pressure Before Screen Pack: 600 psi
Melt Pressure Between Screen Pack: 500 psi
Air Pressure in Die: 2 psi Each of Samples 1 through 15 then were subjected to hydroentanglement as follows.

Each of the Samples 1 through 15 was passed through a hydroentanglement apparatus having two hydroentanglement zones. Each zone included a roller covered with a 100 mesh wire screen upon which the sheet or web was placed, and a manifold system for emitting water jets. Each manifold system included three headers, and three orifice strips which were disposed under each header. Each orifice strip had a width of about ½ inch, and a length which spanned the width of the sheet or web. Each of the orifice strips had holes of a diameter of 0.0050 inch, and the holes were spaced such that there were 40 holes per lineal inch of screen. The first zone treated a first surface (Side 1) of the sheet, and the second zone treated a second surface (Side 2) of the sheet. The sheets were passed through each hydroentanglement zone at a rate of 25 feet per minute. Each side of each sample was contacted with the water jets at a pressure of from 350 psi to 1,500 psi. The weight and hydroentanglement pressure (psi) for each of Samples 1 through 15 is given in Table I below.

TABLE 1

| Sample | Weight (oz.) | Side 1 Pressure (psi) Header No. 1 | 2 | 3 | Side 2 Pressure (psi) Header No. 1 | 2 | 3 |
|---|---|---|---|---|---|---|---|
| 1 | 1 | 350 | 350 | 350 | 500 | 500 | 500 |
| 2 | 3 | 350 | 350 | 350 | 500 | 500 | 500 |
| 3 | 6 | 350 | 350 | 350 | 500 | 500 | 500 |
| 4 | 1 | 500 | 500 | 500 | 500 | 500 | 500 |
| 5 | 3 | 500 | 500 | 500 | 500 | 500 | 500 |
| 6 | 6 | 500 | 500 | 500 | 500 | 500 | 500 |
| 7 | 1 | 500 | 500 | 500 | 750 | 750 | 750 |
| 8 | 3 | 500 | 500 | 500 | 750 | 750 | 750 |
| 9 | 6 | 500 | 500 | 500 | 750 | 750 | 750 |
| 10 | 1 | 500 | 500 | 500 | 1,000 | 1,000 | 1,000 |
| 11 | 3 | 500 | 500 | 500 | 1,000 | 1,000 | 1,000 |
| 12 | 6 | 500 | 500 | 500 | 1,000 | 1,000 | 1,000 |
| 13 | 1 | 1,000 | 1,000 | 1,000 | 1,500 | 1,500 | 1,500 |
| 14 | 3 | 1,000 | 1,000 | 1,000 | 1,500 | 1,500 | 1,500 |
| 15 | 6 | 1,000 | 1,000 | 1,000 | 1,500 | 1,500 | 1,500 |

As the pressure with which the samples were contacted with the water jets increased, the samples became more pliable. Uses for the sheets or webs of the present invention include those hereinabove described, as well as liquid separators in oil-in-water or water-in-oil emulsions, whereby the sheet or web will absorb oil, thereby separating the oil from the water. In addition, the sheets or webs of the present invention may be employed for the separation of oil or other materials from dairy products.

The disclosure of all patents, publications (including published patent applications), and database entries referenced in this specification are specifically incorporated herein by reference in their entirety to the same extent as if each such individual patent, publication, and database entry were specifically and individually indicated to be incorporated by reference.

It is to be understood, however, that the scope of the present invention is not to be limited to the specific embodiments described above. The invention may be practiced other than as particularly described and still be within the scope of the accompanying claims.

What is claimed is:

1. A hydroentangled fluoropolymer fiber sheet.

2. The sheet of claim 1 wherein said fluoropolymer is selected from the group consisting of ethylene/chlorotrifluoroethylene copolymer, ethylene/tetrafluoroethylene copolymer, tetrafluorethylene/hexafluoropropylene copolymer, tetrafluoroethylene/perfluoromethylvinyl ether copolymer, polyvinylidene fluoride, polyvinyl fluoride, hexafluoroisobutylene/vinylidine fluoride copolymer, polytetrafluoroethylene, and polychlorotrifluoroethylene.

3. The sheet of claim 2 wherein said fluoropolymer is an ethylene/chlorotrifluoroethylene copolymer.

4. The sheet of claim 3 wherein said ethylene/chlorotrifluoroethylene copolymer includes from about 40 mole % to about 60 mole % ethylene, and from about 40 mole % to about 60 mole % chlorotrifluoroethylene.

5. The sheet of claim 4 wherein said ethylene/chlorotrifluoroethylene copolymer includes from about 45 mole % to about 55 mole % ethylene, and from about 45 mole % to about 55 mole % chlorotrifluoroethylene.

6. The sheet of claim 5 wherein said ethylene/chlorotrifluoroethylene copolymer includes about 50 mole % ethylene and about 50 mole % chlorotrifluoroethylene.

7. The sheet of claim 3 wherein said ethylene/chlorotrifluoroethylene copolymer has a molecular weight of from about 10,000 to about 3,000,000.

8. The sheet of claim 1 wherein said sheet is formed of hydroentangled fluoropolymer fibers having a diameter of from about 0.2 μm to about 10 μm.

9. The sheet of claim 8 wherein said fibers have a diameter of from about 1 μm to about 9 μm.

10. The sheet of claim 9 wherein said fibers have a diameter of from about 1 μm to about 7 μm.

11. The sheet of claim 10 wherein said fibers have a diameter of from about 3 μm to about 7 μm.

12. A process, comprising:

(a) forming a sheet of fibers of a fluoropolymer; and (b) hydroentangling said fibers of said sheet.

13. The process of claim 12 wherein said fluoropolymer is selected from the group consisting of ethylene/chlorotrifluoroethylene copolymer, ethylene/tetrafluoroethylene copolymer, tetrafluoroethylene/hexafluoropropylene copolymer, tetrafluoroethylene/perfluoromethylvinyl ether copolymer, polyvinylidene fluoride, polyvinyl fluoride, hexafluoroisobutylene/vinylidene fluoride copolymer, polytetrafluoroethylene, and polychlorotrifluoroethylene.

14. The process of claim 13 wherein said fluoropolymer is an ethylene/chlorotrifluoroethylene copolymer.

15. The process of claim 14 wherein said ethylene/chlorotrifluoroethylene copolymer includes from 40 mole % to about 60 mole % ethylene, and from about 40 mole to about 60 mole % chlorotrifluoroethylene.

16. The process of claim 15 wherein said ethylene/chlorotrifluoroethylene copolymer includes from 45 mole % to about 55 mole % ethylene, and from about 45 mole % to about 55 mole % chlorotrifluoroethylene.

17. The process of claim 16 wherein said ethylene/chlorotrifluoroethylene copolymer includes from 50 mole % ethylene and about 50 mole % chlorotrifluoroethylene.

18. The process of claim 14 wherein said ethylene/chlorotrifluoroethylene copolymer has a molecular weight of from about 10,000 to about 3,000,000.

19. The process of claim 12 wherein said fibers have a diameter of from about 0.2 μm to about 10 μm.

20. The process of claim 19 wherein said fibers have a diameter of from about 1 μm to about 9 μm.

21. The process of claim 20 wherein said fibers have a diameter of from about 1 μm to about 7 μm.

22. The process of claim 21 wherein said fibers have a diameter of from about 3 μm to about 7 μm.

23. The process of claim 12 wherein said sheet of fibers of fluoropolymers is formed in step (a) by dry laying.

24. The process of claim 12 wherein said sheet of fibers of fluoropolymers is formed in step (a) by spin bonding.

25. The process of claim 12 wherein said sheet of fibers of fluoropolymers is formed in step (a) by melt blowing.

26. The process of claim 12 wherein said sheet of fibers of fluoropolymers is formed in step (a) by wet laying.

27. The process of claim 12 wherein said sheet of fibers of fluoropolymers is formed in step (a) by carding.

28. The process of claim 12 wherein said sheet includes a first surface and a second surface in apposition to said first surface and said hydroentangling of said fibers comprises:

(i) contacting said first surface with a plurality of water jets at a pressure sufficient to effect hydroentangling of said fibers on said first surface; and (ii) contacting said second surface with a plurality of water jets at a pressure sufficient to effect hydroentangling of said fibers on said second surface.

29. The process of claim 28 wherein said first surface and said second surface are contacted with said plurality of water jets at a pressure of from about 100 psi to about 2,000 psi.

* * * * *